US007568897B2

(12) United States Patent
Grassbaugh et al.

(10) Patent No.: US 7,568,897 B2
(45) Date of Patent: Aug. 4, 2009

(54) SCROLL MACHINE WITH SEAL

(75) Inventors: Walter T. Grassbaugh, Sidney, OH (US); John D. Prenger, Jackson Center, OH (US); Christopher Stover, Versailles, OH (US); Xiaogeng Su, Industrial Park (CN); Hanqing Zhu, Suzhou (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 12/017,217

(22) Filed: Jan. 21, 2008

(65) Prior Publication Data

US 2008/0175737 A1 Jul. 24, 2008

Related U.S. Application Data

(63) Continuation of application No. 11/073,492, filed on Mar. 4, 2005, now Pat. No. 7,338,265.

(51) Int. Cl.
*F04C 18/00* (2006.01)
*F01C 19/00* (2006.01)
*F16J 15/32* (2006.01)

(52) U.S. Cl. ..... 418/55.5; 418/55.1; 418/55.4; 418/57; 277/552; 277/647

(58) Field of Classification Search ..... 418/55.1, 418/55.5, 57, 55.4; 277/552, 647, 926–928
See application file for complete search history.

(56) References Cited

U.S. PATENT DOCUMENTS 4,993,928 A * 2/1991 Fraser, Jr. ..... 418/55.5
5,447,418 A * 9/1995 Takeda et al. ..... 418/55.5
5,494,422 A * 2/1996 Ukai et al. ..... 418/55.1
5,588,820 A * 12/1996 Hill et al. ..... 418/55.5
5,803,716 A * 9/1998 Wallis et al. ..... 417/310
6,027,321 A * 2/2000 Shim et al. ..... 418/55.1
6,077,057 A 6/2000 Hugenroth et al.
6,171,088 B1 * 1/2001 Sun et al. ..... 418/57
6,267,565 B1 * 7/2001 Seibel et al. ..... 417/292
7,338,265 B2 * 3/2008 Grassbaugh et al. ..... 418/55.5

* cited by examiner

*Primary Examiner*—Thomas E Denion
*Assistant Examiner*—Mary A Davis
(74) *Attorney, Agent, or Firm*—Harness, Dickey & Pierce, P.L.C.

(57) ABSTRACT

A compressor may include a housing, a compression mechanism supported within the housing, and a seal assembly. The housing may include a suction pressure region and a first discharge passage in communication with a discharge pressure region. The compression mechanism may include a second discharge passage in communication with the first discharge passage. The seal assembly may be sealingly engaged with the housing and the compression mechanism to define a chamber and to provide sealed communication between the first and second discharge passages. The seal assembly may include a seal member engaged with the compression mechanism and including a leg having an opening therein. The leg may isolate the chamber from the discharge pressure region when in a first position and may provide communication between the chamber and the discharge pressure region through the opening when in a second position different than the first position.

22 Claims, 7 Drawing Sheets

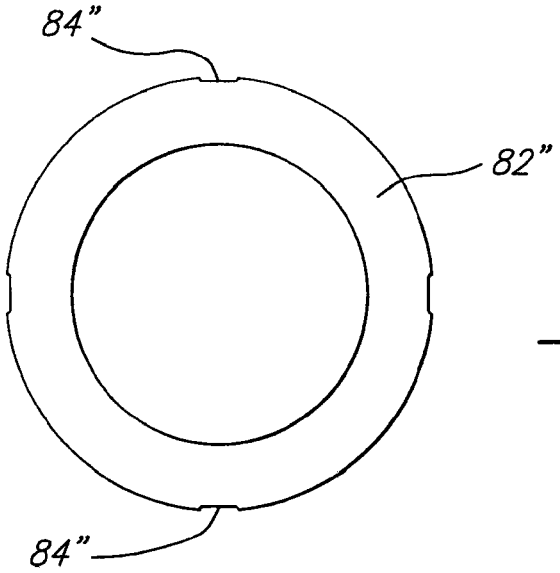
FIG. 11A.
FIG. 11B.
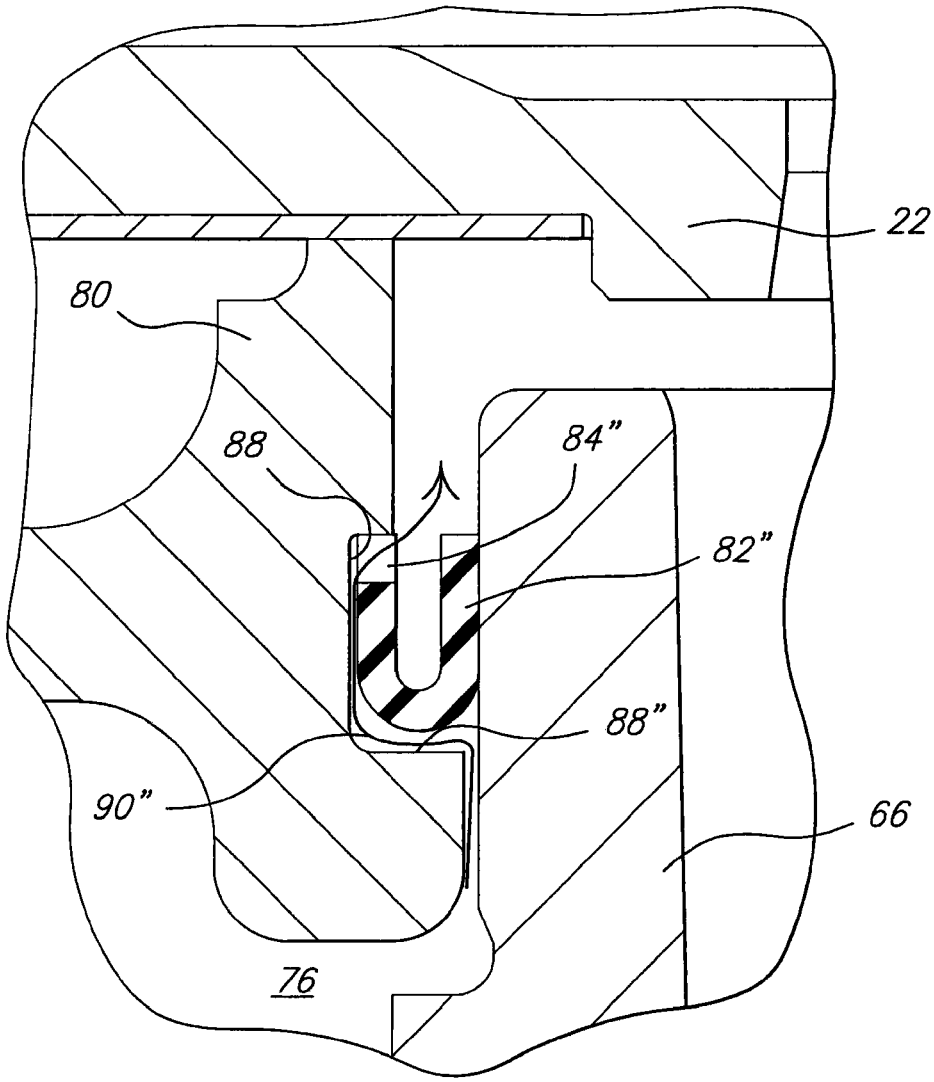

SCROLL MACHINE WITH SEAL

CROSS-REFERENCE TO RELATED APPLICATIONS

This application is a continuation of U.S. patent application Ser. No. 11/073,492 filed on Mar. 4, 2005 now U.S. Pat. No. 7,338,265. The disclosure of the above application is incorporated herein by reference.

FIELD OF THE INVENTION

The present invention relates to scroll compressors, and more specifically, to seal assemblies for scroll compressors.

BACKGROUND AND SUMMARY OF THE INVENTION

A class of machines exists in the art generally known as "scroll" machines for the displacement of various types of fluids. Such machines may be configured as an expander, a displacement engine, a pump, a compressor, etc., and the features of the present invention are applicable to any one of these machines. For purposes of illustration, however, the disclosed embodiments are in the form of a hermetic refrigerant compressor.

Generally speaking, a scroll machine comprises two spiral scroll wraps of similar configuration, each mounted on a separate end plate to define a scroll member. The two scroll members are interfitted together with one of the scroll wraps being rotationally displaced 180° from the other. The machine operates by orbiting one scroll member (the "orbiting scroll") with respect to the other scroll member (the "fixed scroll" or "non-orbiting scroll") to make moving line contacts between the flanks of the respective wraps, defining moving isolated crescent-shaped pockets of fluid. The spirals are commonly formed as involutes of a circle, and ideally there is no relative rotation between the scroll members during operation; i.e., the motion is purely curvilinear translation (i.e., no rotation of any line in the body). The fluid pockets carry the fluid to be handled from a first zone in the scroll machine where a fluid inlet is provided, to a second zone in the machine where a fluid outlet is provided. The volume of a sealed pocket changes as it moves from the first zone to the second zone. At any one instant in time there will be at least one pair of sealed pockets; and where there are several pairs of sealed pockets at one time, each pair will have different volumes. In a compressor, the second zone is at a higher pressure than the first zone and is physically located centrally in the machine, the first zone being located at the outer periphery of the machine.

A compressor may include a housing, a compression mechanism, and a seal assembly. The housing may include a suction pressure region operating at a suction pressure and a first discharge passage in communication with a discharge pressure region operating at a discharge pressure. The compression mechanism may be supported within the housing and may include first and second scroll members meshingly engaged with one another to form a series of compression pockets. The first scroll member may include a second discharge passage in communication with the first discharge passage. The seal assembly may be sealingly engaged with the housing and the compression mechanism to provide sealed communication between the first and second discharge passages. The seal assembly and the compression mechanism may define a chamber in communication with one of the compression pockets. The seal assembly may include a seal member engaged with the compression mechanism and including a leg having an opening therein. The leg may isolate the chamber from the discharge pressure region when in a first position and may provide communication between the chamber and the discharge pressure region through the opening when in a second position different than the first position.

The opening in the leg may include a notch in a first end of the leg that is in communication with the discharge pressure region and isolated from the chamber when the leg is in the first position. The notch may be in communication with the discharge pressure region and the chamber when the leg is in the second position.

A compressor may include a housing, a compression mechanism, and a sealing assembly. The housing may include a first pressure region operating at a first pressure and a first discharge passage in communication with a discharge pressure region operating at a discharge pressure. The compression mechanism may be supported within the housing and may include non-orbiting and orbiting scroll members meshingly engaged with one another to form a series of compression pockets. The non-orbiting scroll member may include a second discharge passage in communication with the first discharge passage. The seal assembly that may be sealingly engaged with the housing and the non-orbiting scroll member to provides sealed communication between the first and second discharge passages, the seal assembly may include a seal member engaged with the non-orbiting scroll member and including a leg having an opening therein. The leg may provide sealed communication between the first and second discharge passages when in a first position and may provide communication between the first pressure region and the discharge pressure region through the opening when in a second position different than the first position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 11A is a plan view of a vented seal assembly in accordance with another embodiment of the present invention; and FIG. 11B is an enlarged view of the vented seal shown in FIG. 11A installed in a compressor.

DETAILED DESCRIPTION OF THE PREFERRED EMBODIMENTS

The following description of the preferred embodiment(s) is merely exemplary in nature and is in no way intended to limit the invention, its application, or uses.

Figure 1:
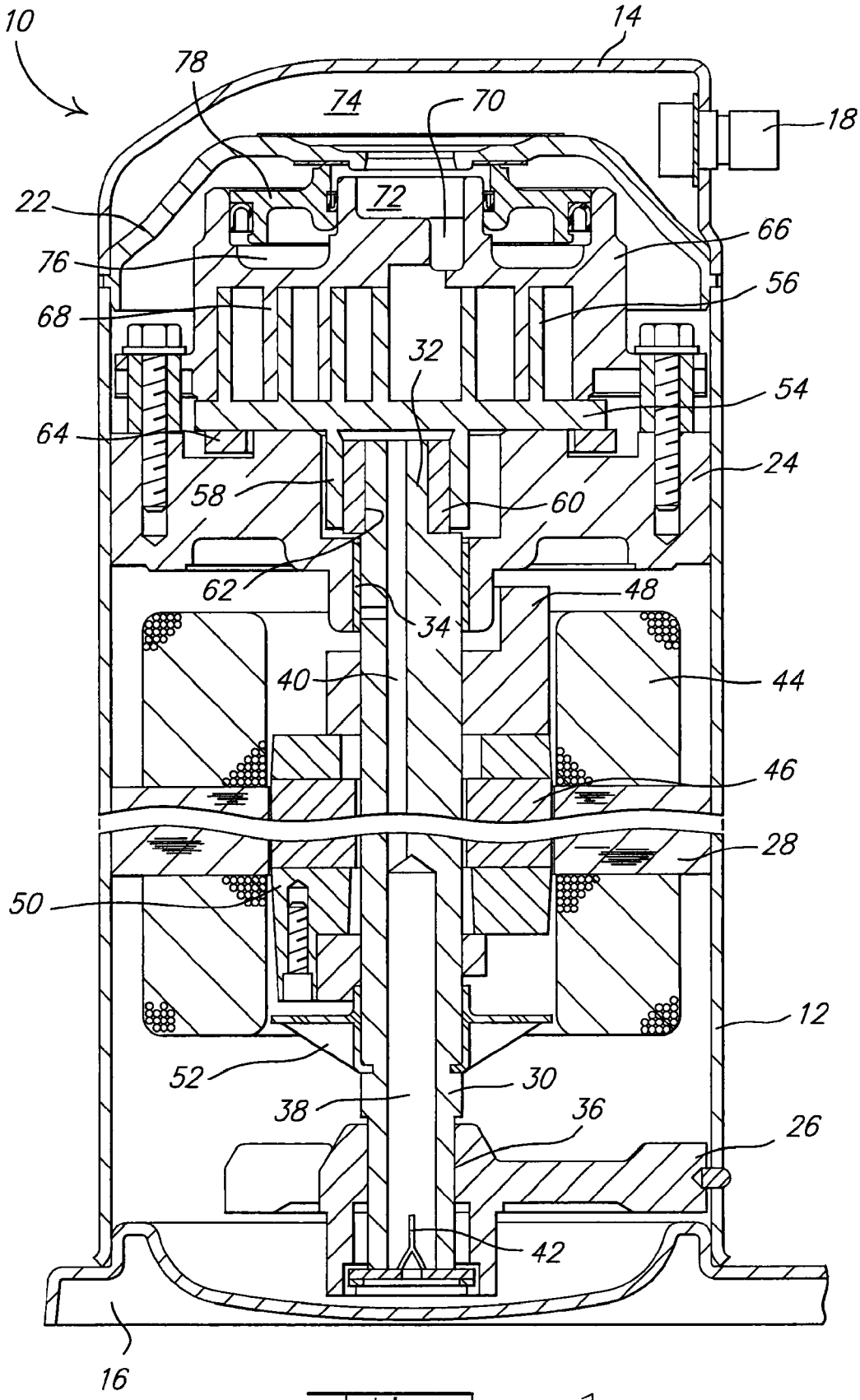
FIG. 1 is a vertical cross-sectional view of a scroll compressor incorporating a floating seal design in accordance with the present invention.

There is illustrated in FIG. 1 a scroll compressor which incorporates a floating seal arrangement in accordance with the present invention and which is designated generally by reference numeral 10. Compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a stationary main bearing housing or body 24 which is suitably secured to shell 12, and a lower bearing housing 26 also having a plurality of radially outwardly extending legs, each of which is also suitably secured to shell 12. A motor stator 28, which is generally square in cross-section but with the corners rounded off, is pressfitted into shell 12. The flats between the rounded corners on the stator provide passageways between the stator and shell, which facilitate the flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of the crankshaft. Disposed within bore 38 is a stirrer 42. The lower portion of the interior shell 12 is filled with lubricating oil, and bore 38 acts as a pump to pump lubricating fluid up the crankshaft 30 and into bore 40, and ultimately to all of the various portions of the compressor which require lubrication.

Crankshaft 30 is rotatively driven by an electric motor including stator 28, windings 44 passing therethrough and a rotor 46 pressfitted on the crankshaft 30 and having upper and lower counterweights 48 and 50, respectively. A counterweight shield 52 may be provided to reduce the work loss caused by counterweight 50 spinning in the oil in the sump. Counterweight shield 52 is more fully disclosed in Assignee's U.S. Pat. No. 5,064,356 entitled "Counterweight Shield For Scroll Compressor," the disclosure of which is hereby incorporated herein by reference.

The upper surface of main bearing housing 24 is provided with a flat thrust bearing surface on which is disposed an orbiting scroll member 54 having the usual spiral vane or wrap 56 on the upper surface thereof. Projecting downwardly from the lower surface of orbiting scroll member 54 is a cylindrical hub 58 having a journal bearing therein and in which is rotatively disposed a drive bushing 60 having an inner bore 62 in which crank pin 32 is drivingly disposed. Crank pin 32 has a flat on one surface which drivingly engages a flat surface (not shown) formed in a portion of bore 62 to provide a radially compliant driving arrangement, such as shown in aforementioned Assignee's U.S. Pat. No. 4,877,382, the disclosure of which is hereby incorporated herein by reference. An Oldham coupling 64 is also provided positioned between and keyed to orbiting scroll member 54 and a non-orbiting scroll member 66 to prevent rotational movement of orbiting scroll member 54. Oldham coupling 64 is preferably of the type disclosed in the above-referenced U.S. Pat. No. 4,877,382; however, the coupling disclosed in Assignee's U.S. Pat. No. 5,320,506 entitled "Oldham Coupling For Scroll Compressor", the disclosure of which is hereby incorporated herein by reference, may be used in place thereof.

Non-orbiting scroll member 66 is also provided having a wrap 68 positioned in meshing engagement with wrap 56 of orbiting scroll member 54. Non-orbiting scroll member 66 has a centrally disposed discharge passage 70 communicating with an upwardly open recess 72 which is in fluid communication with a discharge muffler chamber 74 defined by cap 14 and partition 22 through an opening defined by partition 22. An annular recess 76 is also formed in non-orbiting scroll member 66 within which is disposed a floating seal assembly 78. Recesses 72 and 76 and floating seal assembly 78 cooperate to define axial pressure biasing chambers which receive pressurized fluid being compressed by wraps 56 and 68 so as to exert an axial biasing force on non-orbiting scroll member 66 to thereby urge the tips of respective wraps 56, 68 into sealing engagement with the opposed end plate surfaces.

Figure 2:
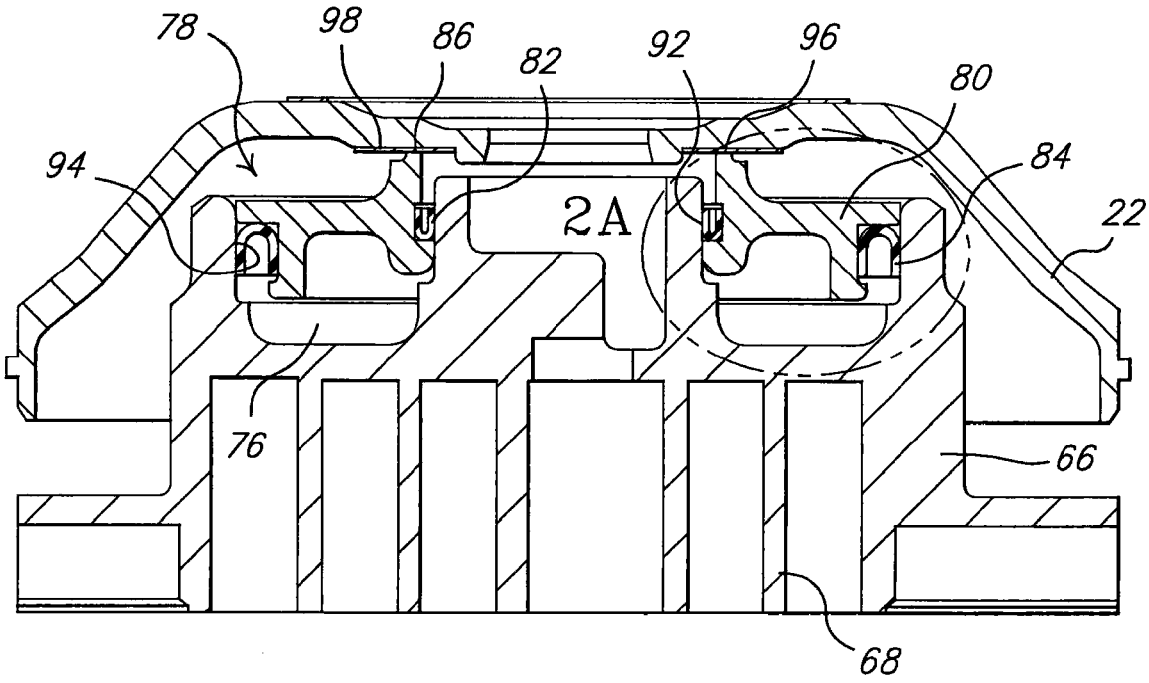
FIG. 2 is an enlarged view of the floating seal illustrated in FIG. 1.

With reference to FIGS. 1 and 2, floating seal assembly 78 comprises a single metal plate 80, an annular inner seal 82 and an annular outer seal 84. Metal plate 80 is preferably manufactured from cast iron or powdered metal but any other material, metal or plastic, which meets the performance requirements for plate 80 may be utilized. Plate 80 includes an upwardly projecting planar sealing lip 86 which engages partition 22 to separate the discharge area of compressor 10 from the suction area of compressor 10.

Annular inner seal 82 is preferably manufactured from a polymer such as glass filled PTFE or Teflon® but any suitable polymer can be used. Annular inner seal 82 is disposed within a groove 88 formed by plate 80. Annular inner seal 82 engages non-orbiting scroll member 66 and plate 80 to separate the discharge area of compressor 10 from the intermediate pressurized fluid within recess 76.

Annular inner seal 82 has a U-shaped cross section with the opening between the legs of the U-shaped cross section being open towards the discharge area of compressor 10 which is at a higher pressure than the intermediate pressurized fluid within recess 76. This orientation for annular inner seal 82 pressure energizes the legs of annular inner seal 82 to improve its performance.

Annular outer seal 84 is preferably manufactured from a polymer such as glass filled PTFE or Teflon® but any suitable polymer can be used. Annular outer seal 84 is disposed within a groove 90 formed by plate 80. Annular outer seal 84 engages non-orbiting scroll member 66 and plate 80 to separate the midway pressurized fluid within recess 76 from the suction area of compressor 10. Annular outer seal 84 has a U-shaped cross section with the opening between the legs of the U-shaped cross section being open towards the intermediate pressurized fluid within recess 76 which is at a higher pressure than the pressurized fluid within the suction area of compressor 10. This orientation for annular outer seal 84 pressure energizes the legs of annular outer seal 84 to improve its performance.

The overall seal assembly therefore provides three distinct seals, namely, an inside diameter seal at 92, an outside diameter seal at 94 and a top seal at 96. Seal 92 isolates fluid under intermediate pressure in the bottom of recess 76 from fluid under discharge pressure in recess 72. Seal 94 isolates fluid under intermediate pressure in the bottom of recess 76 from fluid at suction pressure within shell 12. Seal 96 isolates fluid at suction pressure within shell 12 from fluid at discharge pressure across the top of seal assembly 78. FIGS. 1 and 2 illustrate a wear ring 98 attached to partition 22 which provides seal 96 between plate 80 and wear ring 98. In lieu of wear ring 98, the lower surface of partition 22 can be locally hardened by nitriding, carbo-nitriding or other hardening processes known in the art.

The diameter of seal 96 is chosen so that there is a positive upward sealing force on floating seal assembly 78 under normal operating conditions i.e. at normal pressure ratios. Therefore, when excessive pressure ratios are encountered, floating seal assembly 78 will be forced downwardly by discharge pressure, thereby permitting a leak of high side discharge pressure gas directly across the top of floating seal assembly 78 to a zone of low side suction gas. If this leakage is great enough, the resultant loss of flow of motor cooling suction gas (aggravated by the excessive temperature of the leaking discharge gas) will cause a motor protector (not shown) to trip, thereby de-energizing the motor. The width of seal 96 is chosen so that the unit pressure on the seal itself (i.e. between sealing lip 86 and wear ring 98) is greater than normally encountered discharge pressure, thus insuring consistent sealing.

Figure 2A:
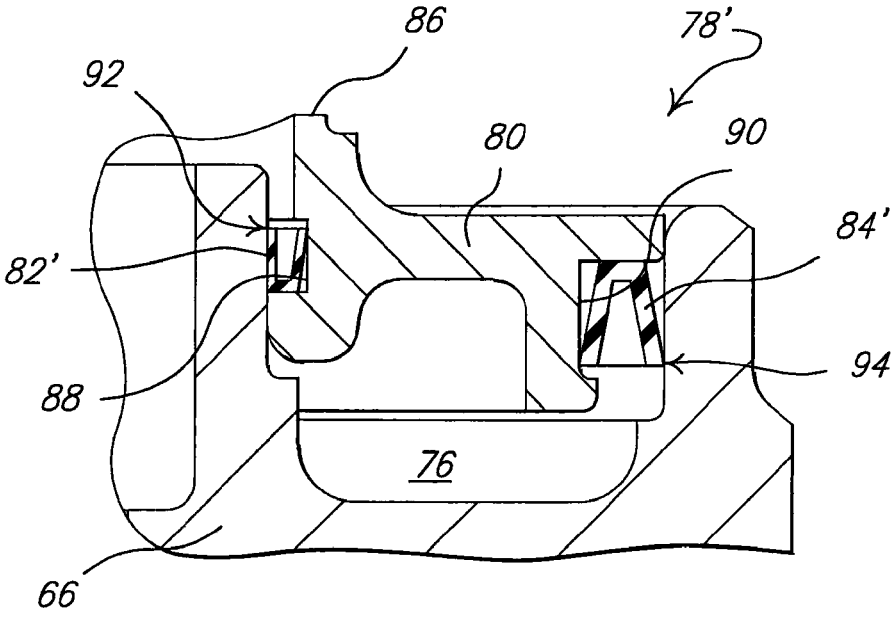
FIG. 2A is an enlarged view of circled 2A in FIG. 2 illustrating a seal in accordance with another embodiment of the present invention.

Referring now to FIG. 2A, a floating seal assembly 78' is illustrated. Floating seal assembly 78' is the same as floating seal assembly 78 except that annular inner seal 82 is replaced by an annular inner seal 82' and annular outer seal 84 is replaced by annular outer seal 84'.

Annular inner seal 82' is the same as annular inner seal 82 except for its cross sectional configuration. Annular inner seal 82' is preferably manufactured from a polymer such as glass filled PTFE or Teflon® but any suitable polymer can be used. Annular inner seal 82' is disposed within groove 88 formed by plate 80. Annular inner seal 82' engages non-orbiting scroll member 66 and plate 80 to form seal 92 which isolates fluid under intermediate pressure in the bottom of recess 76 from fluid under discharge pressure in recess 72. Annular inner seal 82' has a V-shaped cross-section with the opening between the legs of the V-shaped cross section being opened towards the discharge area of compressor 10 which is at a higher pressure than the intermediate pressurized fluid within recess 76. This orientation for annular inner seal 82' pressure energizes the legs of annular inner seal 82' to improve its performance.

Annular outer seal 84' is the same as annular outer seal 84 except for its cross sectional configuration. Annular outer seal 84' is preferably manufactured from a polymer such as glass filled PTFE or Teflon® but any suitable polymer can be used. Annular outer seal 84' engages non-orbiting scroll member 66 and plate 80 to form seal 94 and isolate the intermediate pressurized gas within recess 76 from the suction area of compressor 10. Annular outer seal 84' has a V-shaped cross section with the opening between the legs of the V-shaped cross section being opened towards the intermediate pressurized fluid within recess 76 which is at a higher pressure than the pressurized fluid within the suction area of compressor 10. This orientation for annular outer seal 84' pressure energizes the legs of annular outer seal 84' to improve its performance.

The function, operation and benefits for floating seal assembly 78' are the same as detailed above for floating seal assembly 78 and thus will not be repeated here.

Figure 3:
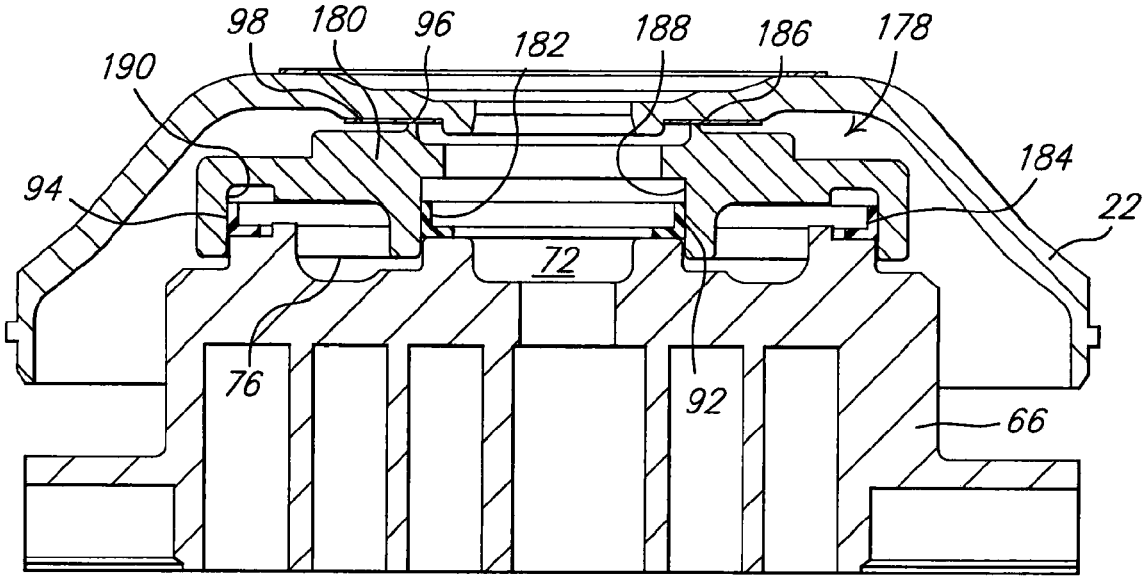
FIG. 3 is a view similar to FIG. 2 but illustrating a floating seal design in accordance with another embodiment of the present invention.

With reference to FIG. 3, a floating seal assembly 178 in accordance with another embodiment of the present invention is illustrated. Floating seal assembly 178 comprises a single metal plate 180, an annular inner seal 182 and an annular outer seal 184. Metal plate 180 is preferably manufactured from cast iron on powdered metal but any other material, metal or plastic, which meets the performance requirements for metal plate 180 may be utilized. Metal plate 180 includes an upwardly projecting planar sealing lip 186 which engages partition 22 to separate the discharge area of compressor 10 from the suction area of compressor 10.

Annular inner seal 182 is preferably manufactured from a polymer such as glass filled PTFE or Teflon® but any suitable polymer can be used. Annular inner seal 182 is disposed within a groove 188 formed by metal plate 180. Annular inner seal 182 engages non-orbiting scroll member 66 and metal plate 180 to separate the discharge area of compressor 10 from the pressurized fluid within recess 76. Annular inner seal 182 has an L-shaped cross-section with the inside surface of the L-shaped cross section facing the discharge area of compressor 10 which is at a higher pressure than the intermediate pressurized fluid within recess 76. This orientation for annular inner seal 182 pressure energizes the legs of annular inner seal 182 to improve its performance.

Annular outer seal 184 is preferably manufactured from a polymer such as glass filled PTFE on Teflon® but any suitable polymer can be used. Annular outer seal 184 is disposed within a groove 190 formed by metal plate 180. Annular outer seal 184 engages non-orbiting scroll member 66 and metal plate 180 to separate the pressurized fluid within recess 76 from the suction area of compressor 10. Annular outer seal 184 has an L-shaped cross-section with the inside surface of the L-shaped cross-section facing the intermediate pressurized fluid within recess 76 which is at a higher pressure the pressurized fluid within the suction area of compressor 10. This orientation for annular outer seal 184 pressure energizes the legs of annular outer seal 184 to improve its performance.

The overall seal assembly therefore provides three distinct seals, namely, an inside diameter seal at 92, an outside diameter seal at 94 and a top seal at 96. Seal 92 isolates fluid under intermediate pressure in the bottom of recess 76 from fluid under discharge pressure in recess 72. Seal 94 isolates fluid under intermediate pressure in the bottom of recess 76 from fluid at suction pressure within shell 12. Seal 96 isolates fluid at suction pressure within shell 12 from fluid at discharge pressure across the top of seal assembly 78. FIG. 3 illustrates wear ring 98 attached to partition 22 which provides seal 96 between plate 180 and wear ring 98. In lieu of wear ring 98, the lower surface of partition 22 can be locally hardened by nitriding, carbo-nitriding or other hardening processes known in the art.

The diameter of seal 96 is chosen so that there is a positive upward sealing force on floating seal assembly 178 under normal operating conditions i.e. at normal pressure differentials. Therefore, when excessive pressure differentials are encountered, floating seal assembly 178 will be forced downwardly by discharge pressure, thereby permitting a leak of high side discharge pressure gas directly across the top of floating seal assembly 178 to a zone of low side suction gas. If this leakage is great enough, the resultant loss of flow of motor cooling suction gas (aggravated by the excessive temperature of the leaking discharge gas) will cause a motor protector (not shown) to trip, thereby de-energizing the motor. The width of seal 96 is chosen so that the unit pressure on the seal itself (i.e. between sealing lip 186 and wear ring 98) is greater than normally encountered discharge pressure, thus insuring consistent sealing.

Figure 4:
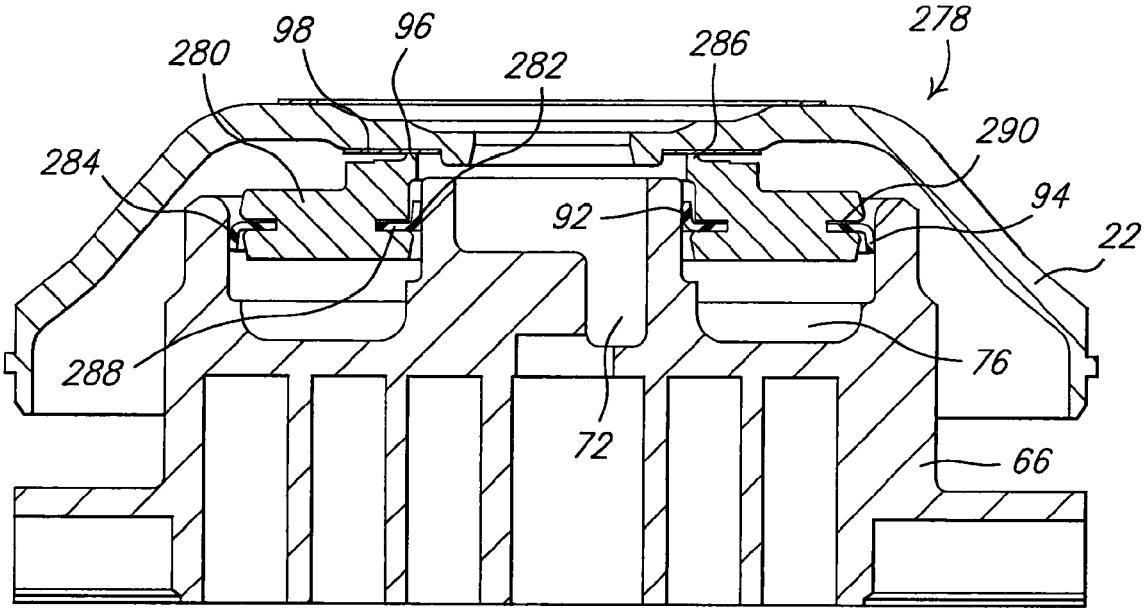
FIG. 4 is a view similar to FIG. 2 but illustrating a floating seal design in accordance with another embodiment of the present invention.

With reference to FIG. 4, a floating seal assembly 278 in accordance with another embodiment of the present invention is illustrated. Floating seal assembly 278 comprises a single metal plate 280, an annular inner seal 282 and an annular outer seal 284. Metal plate 280 is preferably manufactured from cast iron or powdered metal but any other material, metal or plastic, which meets the performance requirements for metal plate 280 may be utilized. Metal plate 280 includes an upwardly projecting planar sealing lip 286 which engages partition 22 to separate the discharge area of compressor 10 from the suction area of compressor 10.

Annular inner seal 282 is preferably manufactured from a polymer such as glass filled PTFE or Teflon® but any suitable polymer can be used. Annular inner seal 282 is disposed within a groove 288 formed by metal plate 280. Annular inner seal 282 engages non-orbiting scroll member 66 and metal plate 280 to separate the discharge area of compressor 10 from the pressurized fluid within recess 76. Annular inner seal 282 has an L-shaped cross-section when it is installed with the inside surface of the L-shaped cross-section facing the discharge area of compressor 10 which is at a higher pressure than the intermediate pressurized fluid within recess 76. This orientation for annular inner seal 282 pressure energizes the legs of annular inner seal 282 to improve its performance.

Annular outer seal 284 is preferably manufactured from a polymer such as glass filled PTFE or Teflon® but any suitable polymer can be used. Annular outer seal 284 is disposed within a groove 290 formed by metal plate 280. Annular outer seal 284 engages non-orbiting scroll member 66 and metal plate 280 to separate the pressurized fluid within recess 76 from the suction area of compressor 10. Annular outer seal 284 has an L-shaped cross-section when it is installed with the inside surface of the L-shaped cross-section facing the intermediate pressurized fluid within recess 76 which is at a higher pressure than the pressurized fluid within the suction area of compressor 10. This orientation for annular outer seal 284 pressure energizes the legs of annular outer seal 284 to improve its performance.

The overall seal assembly therefore provides three distinct seals, namely, an inside diameter seal at 92, an outside diameter seal at 94 and a top seal at 96. Seal 92 isolates fluid under intermediate pressure in the bottom of recess 76 from fluid under discharge pressure in recess 72. Seal 94 isolates fluid under intermediate pressure in the bottom of recess 76 from fluid at suction pressure within shell 12, seal 96 isolates fluid at suction pressure within shell 12 from fluid at discharge pressure across the top of seal assembly 78. FIG. 4 illustrates wear ring 98 attached to partition 22 which provides seal 96 between metal plate 280 and wear ring 98. In lieu of wear ring 98, the lower surface of partition 22 can be locally hardened by nitriding, carbo-nitriding or other hardening processes known in the art.

The diameter of seal 96 is chosen so that there is a positive upward sealing force on floating seal assembly 278 under normal operating conditions i.e. at normal pressure differentials. Therefore, when excessive pressure differentials are encountered, floating seal assembly 278 will be forced downwardly by discharge pressure, thereby permitting a leak of high side discharge pressure gas directly across the top of floating seal assembly 278 to a zone of low side suction gas. If this leakage is great enough, the resultant loss of flow of motor cooling suction gas (aggravated by the excessive temperature of the leaking discharge gas) will cause a motor protector (not shown) to trip, thereby de-energizing the motor. The width of seal 96 is chosen so that the unit pressure on the seal itself (i.e. between sealing lip 286 and wear ring 98) is greater than normally encountered discharge pressure, thus insuring consistent sealing.

Figure 5:
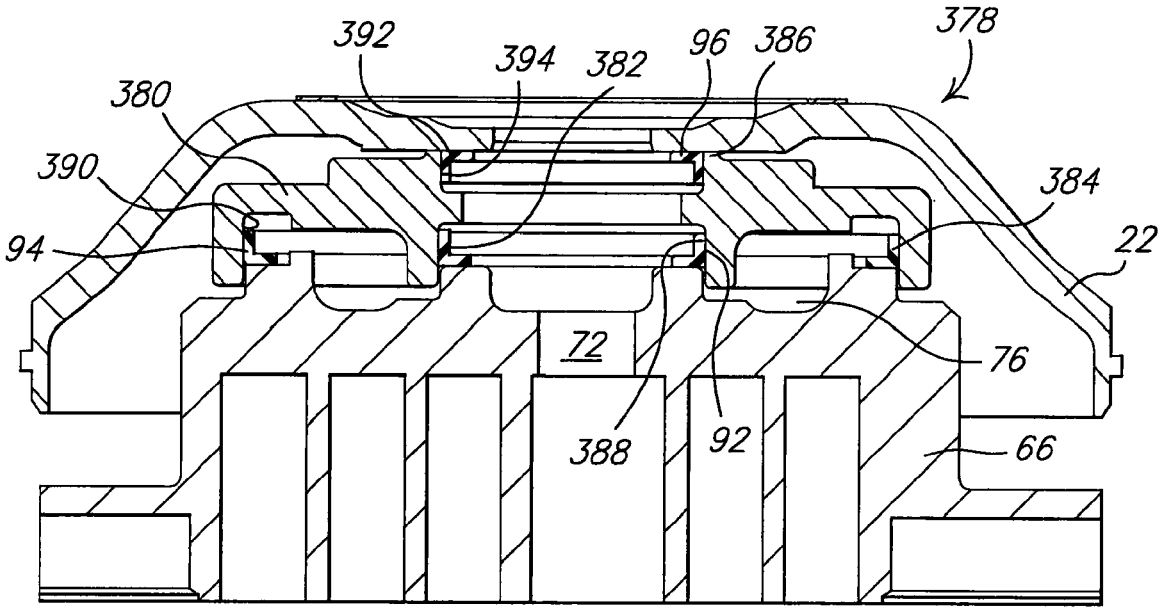
FIG. 5 is a view similar to FIG. 2 but illustrating a floating seal design in accordance with another embodiment of the present invention.

With reference to FIG. 5, a floating seal assembly 378 in accordance with another embodiment of the present invention is illustrated. Floating seal assembly 378 comprises a single metal plate 380, an annular inner seal 382 and an annular outer seal 384. Metal plate 380 is preferably manufactured from cast iron or powdered metal but any other material, metal or plastic, which meets the performance requirements for plate 380 may be utilized. Plate 380 includes an upwardly projecting planar lip 386 which engages partition 22 to limit the movement of metal plate 380.

Annular inner seal 382 is preferably manufactured from a polymer such as glass filled PTFE or Teflon® but any suitable polymer can be used. Annular inner seal 382 is disposed within a groove 388 formed by plate 380. Annular inner seal 382 engages non-orbiting scroll member 66 and plate 380 to separate the discharge area of compressor 10 from the pressurized fluid within recess 76. Annular inner seal 382 has an L-shaped cross-section with the inside surface of the L-shaped cross section facing the discharge area of compressor 10 which is at a higher pressure than the intermediate pressurized fluid within recess 76. This orientation for annular inner seal 382 pressure energizes the legs of annular inner seal 382 to improve its performance.

Annular outer seal 384 is preferably manufactured from a polymer such as glass filled PTFE or Teflon® but any suitable polymer can be used. Annular outer seal 384 is disposed within a groove 390 formed by plate 380. Annular outer seal 384 engages non-orbiting scroll member 66 and plate 380 to separate the pressurized fluid within recess 76 from the suction area of compressor 10. Annular outer seal 384 has an L-shaped cross-section with the inside surface of the L-shaped cross-section facing the intermediate pressurized fluid within recess 76 which is at a higher pressure the pressurized fluid within the suction area of compressor 10. This orientation for annular outer seal 384 pressure energizes the legs of annular outer seal 384 to improve its performance.

Floating seal assembly 378 further comprises an annular seal 392. Annular seal 392 is preferably manufactured from a polymer such as glass filled PTFE or Teflon® but any suitable polymer can be used. Annular seal 392 is disposed within a groove 394 formed by plate 380. Annular seal 392 engages partition 22 and plate 380 to separate the discharge area of compressor 10 from the suction area of compressor 10. Annular seal 392 has an L-shaped cross-section with the inside surface of the L-shaped cross-section facing the discharge area of compressor 10 which is at a higher pressure than the pressurized fluid within the suction area of compressor 10. This orientation for annular seal 392 pressure energizes the legs of annular seal 392 to improve its performance.

The overall seal assembly therefore provides three distinct seals, namely an inside diameter seal at 92, an outside diameter seal at 94 and a top seal at 96. Seal 92 isolates fluid under intermediate pressure in the bottom of recess 76 from fluid under discharge pressure in recess 72. Seal 94 isolates fluid under intermediate pressure in the bottom of recess 76 from fluid at suction pressure within shell 12. Seal 96 isolates fluid under discharge pressure in recess 72 from fluid at suction pressure within shell 12. FIG. 5 does not illustrate the incorporation of wear ring 98. Because annular seal 392 provides top seal 96, wear ring 98 and/or local hardening of partition 22 is not required.

Figure 6:
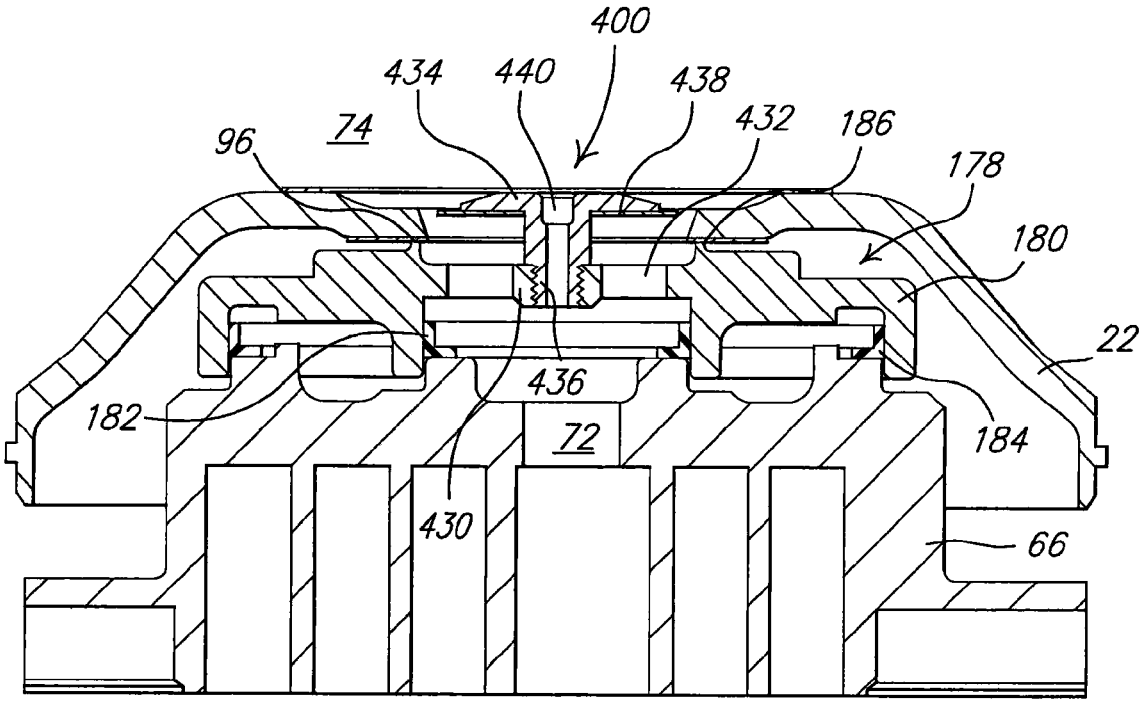
FIG. 6 is a view similar to FIG. 3 but incorporating a discharge valve assembly with the floating seal.

Referring now to FIG. 6, floating seal assembly 178 is illustrated incorporating a discharge valve assembly 400. While discharge valve assembly 400 is illustrated in conjunction with floating seal assembly 178, it is within the scope of the present invention to incorporate discharge valve assembly 400 into floating seal assemblies 78, 278 and 378 if desired.

Discharge valve assembly 400 is disposed within the inner periphery of planar sealing lip 186. Discharge valve assembly 400 includes a discharge valve base 430 which defines a plurality of apertures 432 which permit the flow of compressed gas from recess 72 into discharge muffler chamber 74. A mushroom shaped valve retainer 434 is secured to a central aperture 436 disposed within valve base 430 by a threaded connection or by any other means known in the art. Disposed between valve base 430 and valve retainer 434 is an annular valve disc 438. The diameter of valve disc 438 is large enough to cover the plurality of apertures 432 when valve disc 438 is seated on valve base 430. The diameter of the upper portion of valve retainer 434 which is in contact with valve disc 438 is chosen to be less than and in a desirable proportion to the diameter of valve disc 438 to control the forces acting on the valve during the operation of compressor 10. The diameter of the upper portion of valve retainer 434 is chosen to be between 50% and 100% of the diameter of valve disc 438. In the preferred embodiment, the diameter of the upper portion of valve retainer 434 is chosen to be approximately 95% of the diameter of valve disc 438.

During operation of compressor 10, it is undesirable for valve disc 438 to become dynamic under the flow pulsations that occur during extreme conditions of operation such as at high pressure ratio. The proper contact area between valve disc 438 and valve retainer 434 and a phenomenon known as "stiction" will prevent valve disc 438 from becoming dynamic. Stiction is a temporary time dependent adhesion of valve disc 438 to valve retainer 434 caused by surface tension of lubricating oil being disposed between them.

Valve retainer 434 is provided with a central through aperture 440 which is sized to allow a proper amount of discharge gas to pass through valve retainer 434 when valve disc 438 closes apertures 432. This flow of gas through valve retainer 434 limits the amount of vacuum which can be created during powered reverse rotation of compressor 10. This powered reverse rotation can occur due to a three phase miswiring condition or it can occur due to various situations such as a blocked condenser fan where the discharge pressure builds up to a point of stalling the drive motor. If aperture 440 is chosen too small of a diameter, excess vacuum will be created during reverse operation. If aperture 440 is chose to large, reverse rotation of compressor 10 at shut down will not be adequately prevented.

During normal operation of compressor 10, valve disc 438 is maintained in an open position, as shown in FIG. 6 and pressurized refrigerant flows from open recess 72, through the plurality of apertures 432 and into discharge muffler chamber 74. When compressor 10 is shut down either intentionally as a result of the demand being satisfied or unintentionally as a result of a power interruption, there is a strong tendency for the backflow of compressed refrigerant from discharge muffler chamber 74 and to a lesser degree for the gas in the pressurized chambers defined by scroll wraps 56 and 68 to effect a reverse orbital movement of orbiting scroll member 54. Valve disc 438 is initially held in its open position due to stiction as described above. When compressor 10 is shut down, the forces due to the initial reverse flow of compressed refrigerant and, in this particular design to a lesser extent, those due to the force of gravity will eventually overcome the temporary time dependent "stiction" adhesion and valve disc 438 will drop onto valve base 430 and close the plurality of apertures 432 and stop the flow of compressed refrigerant out of discharge muffler chamber 74 except for the amount allowed to flow through aperture 440. The limited flow through aperture 440 is not sufficient to prevent floating seal assembly 178 from dropping thus enabling the breaking of seal 96 and allowing refrigerant at discharge pressure to flow to the suction pressure area of compressor 10 to equalize the two pressures and stop reverse rotation of orbiting scroll member 54.

Thus, floating seal assembly 178 which includes valve base 430, valve retainer 434 and valve disc 438 limits the amount of pressurized refrigerant that is allowed to backflow through compressor 10 after shut down. This limiting of refrigerant backflow has the ability to control the shut down noise without having an adverse impact on the performance of compressor 10. The control of shut down noise is thus accomplished in a simple and low cost manner.

During powered reversals, aperture 440 allows sufficient refrigerant backflow to limit any vacuum from being created and thus provides sufficient volume of refrigerant to protect scroll members 54 and 66 until the motor protector trips and stops compressor 10.

Figure 7:
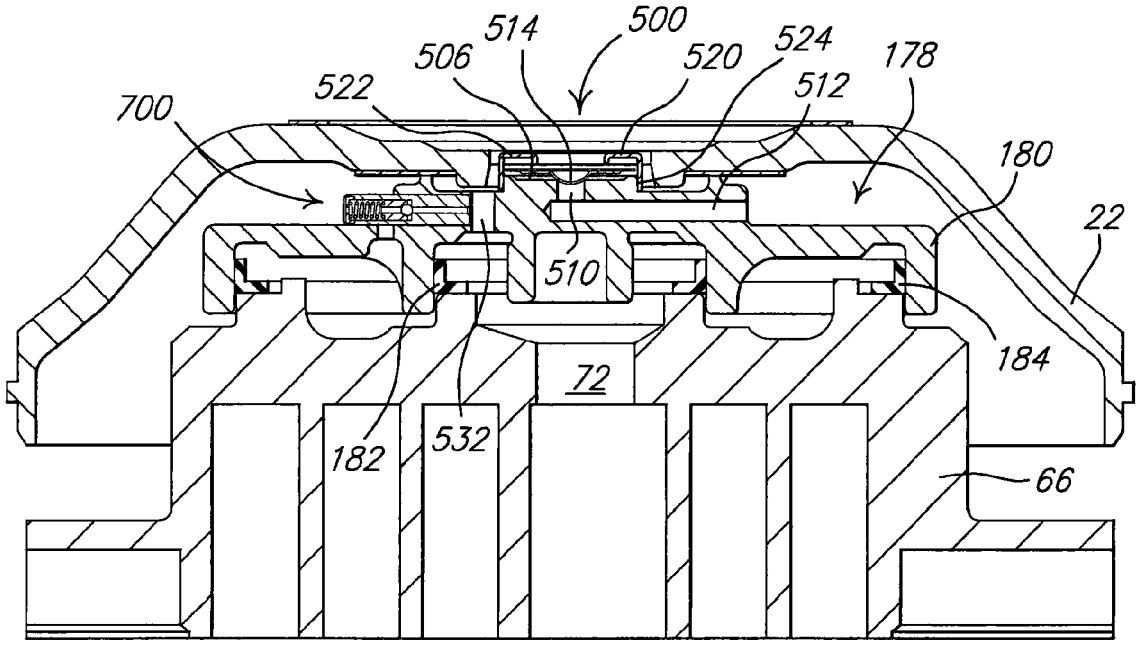
FIG. 7 is a view similar to FIG. 3 but incorporating a temperature protection system with the floating seal.

Referring now to FIG. 7, floating seal assembly 178 is illustrated incorporating a temperature protection system 500 and a pressure protection system 700. While temperature protection system 500 is illustrated in conjunction with floating seal assembly 178, it is within the scope of the present invention to incorporate temperature protection system 500 into floating seal assemblies 78, 278 and 378 if desired.

Temperature protection system 500 comprises a circular valve cavity 506 disposed within plate 180. The bottom of cavity 506 communicates with an axial passage 510 of circular cross-section which is in turn in communication with a radial passage 512. The radially outer outlet end of passage 512 is in communication with the suction gas area within shell 12. The intersection of passage 510 and the planar bottom of cavity 506 define a circular valve seat in which is normally disposed the spherical center valving portion of a circular slightly spherical relatively thin saucer-like bi-metallic valve 514 having a plurality of through holes disposed radially outwardly of the spherical valving portion.

Valve 514 is retained in place by a cup-shaped retainer 520 which has an open center portion and a radially outwardly extending flange 522. After valve 514 is assembled in place, retaining ring 520 is pushed over a cylindrical surface 524 formed on plate 180 to retain the assembly of valve 514.

Being disposed adjacent discharge gas recess 72, temperature protection system 500 is fully exposed to the temperature of the discharge gas very close to where it exits scroll wraps 56 and 68. The closer the location at which the discharge gas temperature is sensed is to the actual discharge gas temperature existing in the last scroll compression bucket, the more accurately the machine will be controlled in response to discharge temperature. The materials of bi-metallic valve 514 are chosen, using conventional criteria, so that when discharge gas reaches a predetermined temperature, valve 514 will "snap" into its open position in which it is slightly concave upwardly with its outer periphery engaging the bottom of cavity 506 and its center valving portion elevated away from the valve seat. In this position, high pressure discharge gas can leak through the holes in valve 514 and passages 510 and 512 to the interior of shell 12 at suction pressure. This leakage causes the discharge gas to be recirculated thus reducing the inflow of cool suction gas as a consequence of which, the motor loses its flow of cooling fluid, i.e. the inlet flow of relatively cool suction gas. A motor protector (not shown) will heat up due to both the presence of relatively hot discharge gas and the reduced flow of cooling gas. The motor protector will eventually trip thus shutting down compressor 10. When temperature protection system 500 is closed, discharge gas flows from recess 72 through one or more apertures 532, through partition 22 and into discharge muffler chamber 74. Pressure protection system 700 as discussed below with reference to FIGS. 9, 10A and 10B can be incorporated with floating seal assembly 378 as illustrated in FIG. 7.

Figure 8:
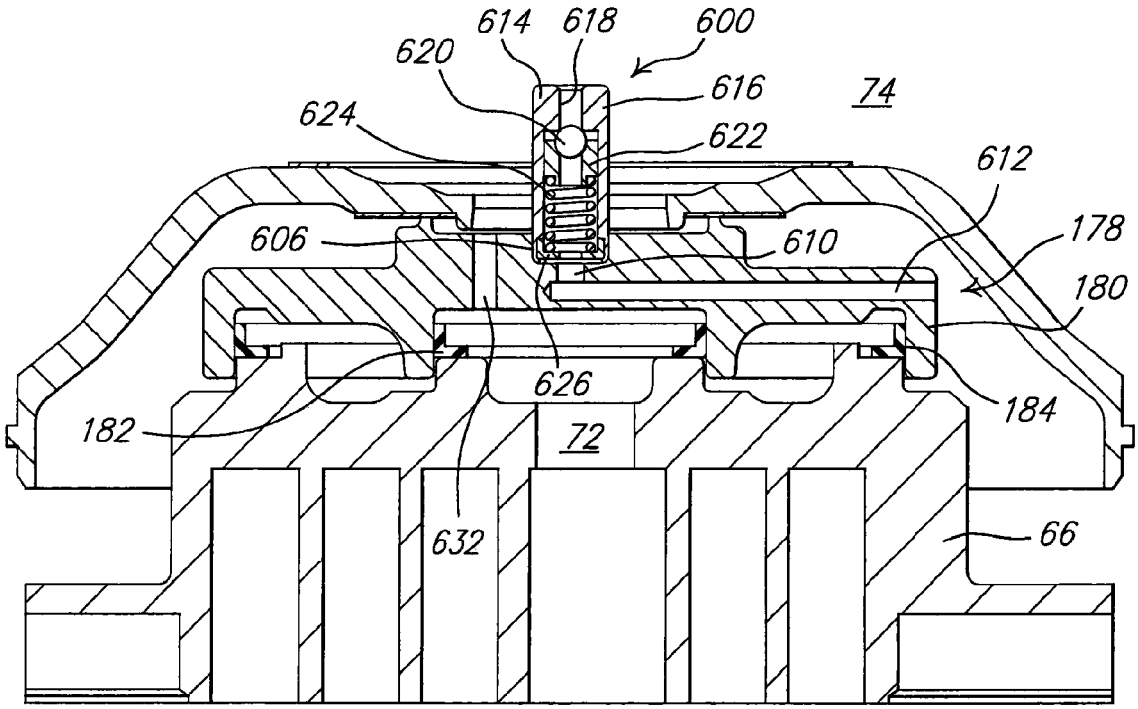
FIG. 8 is a view similar to FIG. 3 but incorporating a pressure protection system with the floating seal.

Referring now to FIG. 8, floating seal assembly 178 is illustrated incorporating a pressure protection system 600. While pressure protection system 600 is illustrated in conjunction with floating seal assembly 178, it is within the scope of the present invention to incorporate pressure protection system 600 into floating seal assemblies 78, 278 and 378 if desired.

Pressure protection system 600 comprises a valve cavity 606 disposed within plate 180. The bottom of cavity 606 communicates with an axial passage 610 of circular cross-section which is in turn in communication with a radial passage 612. The radially outer end of passage 612 is in communication with the suction gas area within shell 12.

A pressure responsive valve 614 is disposed within cavity 606 by being press fit, by being threaded or by other means known in the art. Pressure responsive valve 614 comprises an outer housing 616 defining a stepped fluid passage 618, a ball 620, an inner housing 622, a biasing member 624 and a spring seat 626. Outer housing 616 is secured within cavity 606 such that stepped fluid passage 618 is in communication with discharge muffler chamber 74 and axial passage 610. Ball 620 is disposed within stepped fluid passage 618 and under normal conditions, ball 620 engages a valve seat defined by stepped fluid passage 618, inner housing 622 is disposed below ball 620, biasing member 624 is disposed below inner housing 622 and spring seat 626 is disposed below biasing member 624. Biasing member 624 biases inner housing 622 against ball 620 and ball 620 against the valve seat defined by stepped fluid passage 618 to close stepped fluid passage 618 during normal operating conditions for compressor 10. Discharge gas flows from recess 72 through one or more apertures 632, through partition 22 and into discharge muffler chamber 74.

When fluid pressure within discharge muffler chamber 74 exceeds a predetermined value, the fluid pressure acting against ball 620 will overcome the biasing load of biasing member 624 and ball 620 will be moved off of the valve seat defined by stepped fluid passage 618. In this position, high pressure discharge gas will pass through stepped fluid passage 618 and through passages 610 and 612 to the interior of shell 12 at suction pressure. This leakage causes the discharge gas to be recirculated thus reducing the inflow of cool suction gas as a consequence of which, the motor loses its flow of cooling fluid i.e. the inlet flow of relatively cool suction gas. A motor protector (not shown) will heat up due to both the presence of relatively hot discharge gas and the reduced flow of cooling gas. The motor protector will eventually trip thus shutting down compressor 10.

Figure 9:
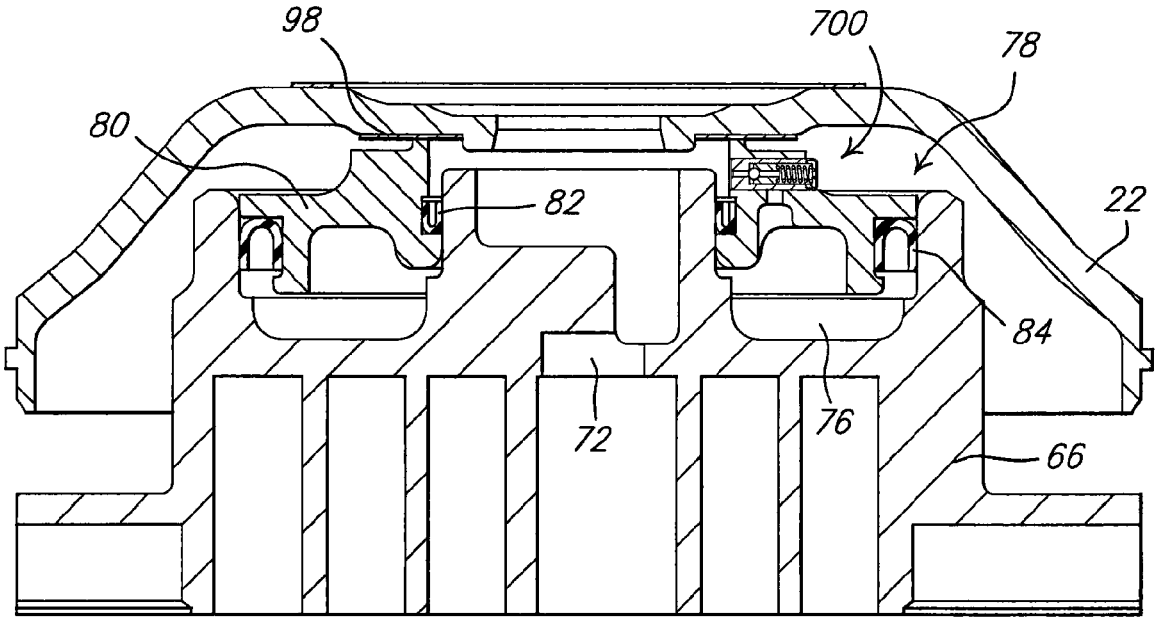
FIG. 9 is a view similar to FIG. 2 but incorporating a pressure protection system with the floating seal in accordance with another embodiment of the present invention.
Figure 10A:
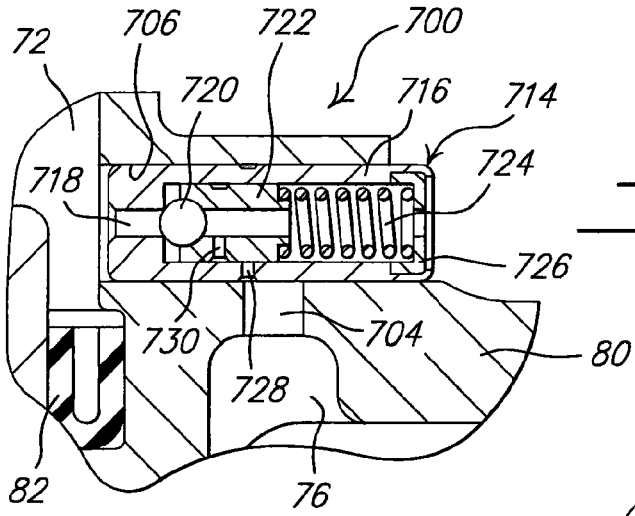
FIG. 10A is an enlarged view of the pressure relief valve illustrated in FIGS. 7 and 9 in its closed position.
Figure 10B:
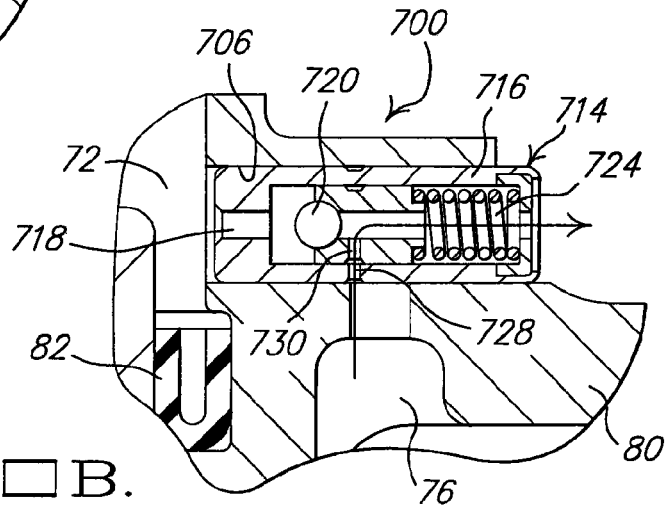
FIG. 10B is an enlarged view of the pressure relief valve illustrated in FIGS. 7 and 9 in its open position.

Referring now to FIGS. 9, 10A and 10B, floating seal assembly 78 is illustrated incorporating pressure protection system 700. While pressure protection system 700 is illustrated in conjunction with floating seal assembly 78, it is within the scope of the present invention to incorporate pressure protection system 700 into floating seal assembly 178, 278 and 378 if desired.

Pressure protection system 700 comprises a fluid passage 704 and a valve cavity 706 disposed within plate 80. Fluid passage 704 extends between recess 76 and valve cavity 706. One end of valve cavity 706 is in communication with the suction area of compressor 10 within shell 12. The other end of valve cavity 706 is in communication with gas at discharge pressure within recess 72.

A pressure responsive valve 714 is disposed within cavity 706 by being press fit, by being threaded or by other means known in the art. Pressure responsive valve 714 comprises an outer housing 716 defining a stepped fluid passage 718, a ball 720, an inner housing 722 a biasing member 724 and a spring seat 726. Outer housing 716 is secured within cavity 706 such that stepped fluid passage 718 is in communication with recess 72 at one end and in communication with gas at suction pressure within shell 12 at its opposite end. A radial passage 728 extends between recess 76 and stepped fluid passage 718. Ball 720 is disposed within stepped fluid passage 718 adjacent the valve seat and under normal operating conditions ball 720 engages the valve seat to close stepped fluid passage 718. Inner housing 722 is disposed adjacent ball 720 and it defines a radial passage 730 whose function is described below. Biasing member 724 is disposed adjacent inner housing 722 and spring seat 726 is disposed adjacent biasing member 724. As illustrated in FIG. 10A, biasing member 724 biases inner housing 722 against ball 720 and ball 720 against the valve seat defined by stepped fluid passage 718 during normal operations of compressor 10. In this position, radial passage 730 is out of alignment with radial passage 728 and fluid flow from recess 76 to the suction area of compressor 10 is prohibited.

When fluid pressure within recess 72 exceeds a predetermined value, the fluid pressure acting against ball 720 will overcome the biasing load of biasing member 724 and ball 720 along with inner housing 722 will be moved to the position illustrated in FIG. 10B. In this position, radial passage 730 will align with radial passage 728 and intermediate pressurized gas within recess 76 will be vented to the suction area of compressor 10 within shell 12. The loss of the intermediate pressurized gas within recess 76 will cause floating seal assembly 78 to drop thus breaking seal 96 between plate 80 and wear ring 98 and allowing discharge gas to leak to suction. In addition, the biasing load urging non-orbiting scroll member 66 into engagement with orbiting scroll member 54 will decrease creating a fluid leak between the discharge and suction areas of compressor 10 across the tips of scroll wraps 56 and 68. This leakage from discharge to suction causes the discharge gas to be recirculated thus reducing the inflow of cool suction gas as a consequence of which the motor loses its flow of cooling fluid i.e. the inlet flow of relatively cool suction gas. A motor protector (not shown) will heat up due to both the presence of relatively hot discharge gas and the reduced flow of cooling gas. The motor protector will eventually trip thus shutting down compressor 10.

Referring now to FIGS. 11A and 11B, an annular inner seal 82" in accordance with another embodiment of the present invention is illustrated. FIG. 11A illustrates annular inner seal 82" in its formed condition and FIG. 11B illustrates annular inner 82" in its assembled condition. Annular inner seal 82" is a direct replacement for annular inner seal 82 illustrated in FIGS. 1 and 2 and thus the description of FIGS. 1 and 2 including the discussion of annular inner seal 82 apply also to annular inner seal 82".

Annular inner seal 82" is preferably manufactured from a polymer such as glass filled PTFE or Teflon® but any suitable polymer can be used. Annular inner seal 82" is designed to be disposed within groove 88 formed by plate 80. Annular inner seal 82" engages non-orbiting scroll member 66 and plate 80 to separate the discharge area of compressor 10 from the intermediate pressurized fluid within recess 76.

When assembled, annular inner seal 82" has a U-shaped cross-section with the opening between the legs of the U-shaped cross-section being open towards the discharge area of compressor 10 which is at a higher pressure than the intermediate pressurized fluid within recess 76 during normal operation of compressor 10. This orientation for annular inner seal 82" energizes the legs of annular inner seal 82" as well as urging annular inner seal 82" into contact with the lower surface 88" of groove 88 to improve its performance.

Annular inner seal 82" defines a plurality of notches 84" which extend through the end of the leg in contact with metal plate 80 as illustrated in FIG. 11B. Notches 84" act as a vent to relieve fluid pressure within recess 76 during a flooded start of compressor 10.

During a flooded start of compressor 10, recess 76 will contain liquid refrigerant. Compressor 10 has the capability of the flooded start due to the radial compliancy, built into compressor 10. During the flooded start of compressor 10, the liquid refrigerant within recess 76 flashes off to create a fluid pressure within recess 76 that is greater than the fluid pressure within discharge muffler chamber 74. This increased pressure will lift annular inner seal 82" away from lower surface 88" as shown in FIG. 11B. Notches 84" help to create a flow path depicted by arrow 90" which bleeds the excessive pressurized fluid off to discharge muffler chamber 74. When fluid pressure within discharge muffler chamber 74 exceeds fluid pressure within recess 76, annular inner seal 82" will again be urged against lower surface 88". This additional sealing point in conjunction with the energizing of the legs of annular inner seal 82" will minimize any effect notches 84" will have on the sealing by annular inner seal 82" during normal operation of compressor 10.

While notches 84" have been illustrated and described in relation to annular inner seal 82", it is within the scope of the present invention to incorporate notches 84" into annular inner seal 82', annular inner seal 182, annular inner seal 282 or annular inner seal 382 if desired.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A compressor comprising:

a housing including a partition separating a suction pressure region operating at a suction pressure from a discharge pressure region operating at a discharge pressure and defining a housing discharge passage in communication with the discharge pressure region;

a compression mechanism supported within said housing and including first and second scroll members meshingly engaged with one another to form a series of compression pockets, said first scroll member including a scroll discharge passage in communication with said housing discharge passage; and a seal assembly that is sealingly engaged with said partition and said compression mechanism and defining a sealed discharge region from said scroll discharge passage to said housing discharge passage, said seal assembly and said compression mechanism defining a chamber in communication with one of said compression pockets, said seal assembly including a seal member engaged with said compression mechanism and including a leg having an opening therein, said leg being displaceable between a first position and a second position different than the first position during compressor operation, said leg isolating said chamber from said sealed discharge region when in the first position and said leg providing communication between said chamber and said sealed discharge region through said opening when in the second position.

2. The compressor of claim 1, wherein said opening includes a notch in an end of said leg.

3. The compressor of claim 1, wherein said first scroll member is axially displaceable relative to said second scroll member.

4. The compressor of claim 1, wherein said leg is displaced from the first position to the second position when a fluid pressure within said chamber is greater than a fluid pressure within said sealed discharge region.

5. The compressor of claim 4, wherein said leg is displaced from the first position to the second position by the fluid pressure within said chamber acting on said leg.

6. The compressor of claim 1, wherein said leg is maintained in the first position during compressor operation when a fluid pressure within said chamber is less than a fluid pressure within said sealed discharge region.

7. The compressor of claim 6, wherein said leg is maintained in the first position by the fluid pressure within said sealed discharge region acting on said leg.

8. The compressor of claim 1, wherein said opening is in communication with said sealed discharge region when said leg is in the first and second positions.

9. A compressor comprising:

a housing including a partition separating a suction pressure region operating at a suction pressure from a discharge pressure region operating at a discharge pressure and defining a housing discharge passage in communication with the discharge pressure region;

a compression mechanism supported within said housing and including first and second scroll members meshingly engaged with one another to form a series of compression pockets, said first scroll member including a scroll discharge passage in communication with said housing discharge passage; and a seal assembly that is sealingly engaged with said partition and said compression mechanism and defining a sealed discharge region from said scroll discharge passage to said housing discharge passage, said seal assembly and said compression mechanism defining a chamber in communication with one of said compression pockets, said seal assembly including a seal member engaged with said compression mechanism and including a leg having a notch in a first end thereof, said leg being displaceable between a first position and a second position different than the first position during compressor operation, said notch being in communication with said sealed discharge region and isolated from said chamber when said leg is in the first position and said notch being in communication with said sealed discharge region and said chamber when said leg is in the second position.

10. The compressor of claim 9, wherein said first scroll member is axially displaceable relative to said second scroll member.

11. The compressor of claim 9, wherein said leg is displaced from the first position to the second position when a fluid pressure within said chamber is greater than a fluid pressure within said sealed discharge region.

12. The compressor of claim 11, wherein said leg is displaced from the first position to the second position by the fluid pressure within said chamber acting on said leg.

13. The compressor of claim 9, wherein said leg is maintained in the first position during compressor operation when a fluid pressure within said chamber is less than a fluid pressure within said sealed discharge region.

14. The compressor of claim 13, wherein said leg is maintained in the first position by the fluid pressure within said sealed discharge region acting on said leg.

15. A compressor comprising:

a housing including a partition separating a first pressure region operating at a first pressure from a discharge pressure region operating at a discharge pressure and defining a housing discharge passage in communication with the discharge pressure region;

a compression mechanism supported within said housing and including non-orbiting and orbiting scroll members meshingly engaged with one another to form a series of compression pockets, said non-orbiting scroll member including a scroll discharge passage in communication with said housing discharge passage; and a seal assembly that is sealingly engaged with said partition and said non-orbiting scroll member and defining a sealed discharge region from said scroll discharge passage to said housing discharge passage, said seal assembly and said compression mechanism defining a chamber in communication with one of said compression pockets, said seal assembly including a seal member engaged with said non-orbiting scroll member and including a leg having an opening therein, said leg being displaceable between a first position and a second position different than the first position during compressor operation, said leg isolating said chamber from said sealed discharge region when in the first position and said leg providing communication between said chamber and said sealed discharge region through said opening when in the second position.

16. The compressor of claim 15, wherein said opening includes a notch in an end of said leg.

17. The compressor of claim 15, wherein said non-orbiting scroll member is axially displaceable relative to said orbiting scroll member.

18. The compressor of claim 15, wherein said leg is displaced from the first position to the second position when a fluid pressure within said first pressure region is greater than a fluid pressure within said sealed discharge region.

19. The compressor of claim 18, wherein said leg is displaced from the first position to the second position by the fluid pressure within said first pressure region acting on said leg.

20. The compressor of claim 15, wherein said leg is maintained in the first position during compressor operation when a fluid pressure within said first pressure region is less than a fluid pressure within said sealed discharge region.

21. The compressor of claim 20, wherein said leg is maintained in the first position by the fluid pressure within said sealed discharge region acting on said leg.

22. The compressor of claim 15, wherein said opening is in communication with said sealed discharge region when said leg is in the first and second positions.

* * * * *